US009427752B2

(12) United States Patent
Strand et al.

(10) Patent No.: US 9,427,752 B2
(45) Date of Patent: Aug. 30, 2016

(54) DISPENSING HEADS WITH FLUID PUDDLE LIMITING SURFACE FEATURES

(75) Inventors: Thomas R Strand, Corvallis, OR (US); Jeffrey A Nielsen, Corvallis, OR (US); James A Feinn, San Diego, CA (US); Stan E Leigh, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 31 days.

(21) Appl. No.: 14/241,129

(22) PCT Filed: Sep. 30, 2011

(86) PCT No.: PCT/US2011/054171

§ 371 (c)(1),
(2), (4) Date: Feb. 26, 2014

(87) PCT Pub. No.: WO2013/048432

PCT Pub. Date: Apr. 4, 2013

(65) Prior Publication Data

US 2014/0217201 A1 Aug. 7, 2014

(51) Int. Cl.

| | |
|---|---|
| ***B05B 1/28*** | (2006.01) |
| ***B41J 2/14*** | (2006.01) |
| ***B41J 2/16*** | (2006.01) |

(52) U.S. Cl.

CPC ..... *B05B 1/28* (2013.01); *B41J 2/1404* (2013.01); *B41J 2/16* (2013.01); *Y10T 29/49401* (2015.01)

(58) Field of Classification Search

CPC ..... B05B 7/10; B05B 7/0458; B05B 7/066; B05B 7/413; B05B 15/0443

USPC ..... 239/104, 105, 461, 483, 489, 494

See application file for complete search history.

(56) References Cited

U.S. PATENT DOCUMENTS

| | | | | |
|---|---|---|---|---|
| 4,478,368 | A * | 10/1984 | Yie | B05B 7/1431 239/430 |
| 5,395,050 | A * | 3/1995 | Nowak | F02M 51/0682 239/121 |
| 5,465,906 | A * | 11/1995 | Hans | 239/489 |
| 6,520,617 | B2 | 2/2003 | Blair | |
| 6,527,370 | B1 | 3/2003 | Courian et al. | |
| 6,938,988 | B2 | 9/2005 | Clark | |
| 2001/0028378 | A1* | 10/2001 | Lee et al. | 347/68 |
| 2003/0001919 | A1 | 1/2003 | Blair | |
| 2004/0155928 | A1 | 8/2004 | Clark et al. | |
| 2006/0033783 | A1 | 2/2006 | Bruinsma et al. | |
| 2008/0246804 | A1 | 10/2008 | Kawase et al. | |

FOREIGN PATENT DOCUMENTS

| | | |
|---|---|---|
| JP | 2004230745 | 8/2004 |

* cited by examiner

*Primary Examiner* — Davis Hwu

(74) *Attorney, Agent, or Firm* — HP Inc. Patent Department

(57) ABSTRACT

Methods and apparatus are provided related to fluid dispensing heads. A dispense head is formed to define a plurality of fluid jetting nozzles and a surface pattern. The surface pattern is characterized by one or more voids extending inward from an outer surface of the dispense head. Fluid puddle formation during operation of the dispense head is limited in volume by way of the surface pattern. Fluid puddle limiting reduces or eliminates dispensing errors to an entity, undesirable artifacts from resulting on a printed media, or similar problems.

16 Claims, 7 Drawing Sheets

DISPENSING HEADS WITH FLUID PUDDLE LIMITING SURFACE FEATURES

BACKGROUND

Ink jetting printers, laboratory equipment and other devices eject fluid from nozzles so as to form images on media, deposit fluid into receptacles of a wellplate, or the like. Puddling of fluid sometimes results on an outer surface of such an entity during normal operations. Incomplete dispensing into wellplates or streaks, spots or other undesirable artifacts on a printed media can result if such puddles achieve sufficient volume. The present teachings address the foregoing and related concerns.

BRIEF DESCRIPTION OF THE DRAWINGS

The present embodiments will now be described, by way of example, with reference to the accompanying drawings, in which.

DETAILED DESCRIPTION

Introduction

Methods and apparatus are provided related to dispense heads. A dispense head is formed to define a plurality of fluid jetting nozzles and a surface pattern. The surface pattern is characterized by one or more voids extending inward from an outer surface of the dispense head. Fluid puddle formation during operation of the dispense head is limited in volume by way of the surface pattern. Fluid puddle limiting reduces or eliminates dispensing errors to a receiving entity, or undesirable artifacts from resulting on a printed media.

In one example, a dispense head includes a material defining a fluid-jetting nozzle. The material further defines a surface pattern spaced apart from the fluid jetting nozzle. The surface pattern is configured to limit a volume of a fluid puddle for in on an outer surface of the material during operation.

In another example, a fluid dispensing apparatus includes a dispense head configured to eject fluid through a plurality of nozzles. The dispense head includes a surface pattern configured to limit fluid puddle formations on a surface of the dispense head during operation. The apparatus also includes a controller configured to control operation of the dispense head so as to dispense patterns of fluid to a receiving entity.

In still another example, a method includes forming a dispense head from a solid material to define a plurality of nozzles and a surface pattern. The surface pattern is configured to limit a volume of fluid forming on a surface of the dispense head during operations. The surface pattern is characterized by one or more voids extending inward from a surface of the dispense head.

Illustrative Dispense Head

Figure 1:
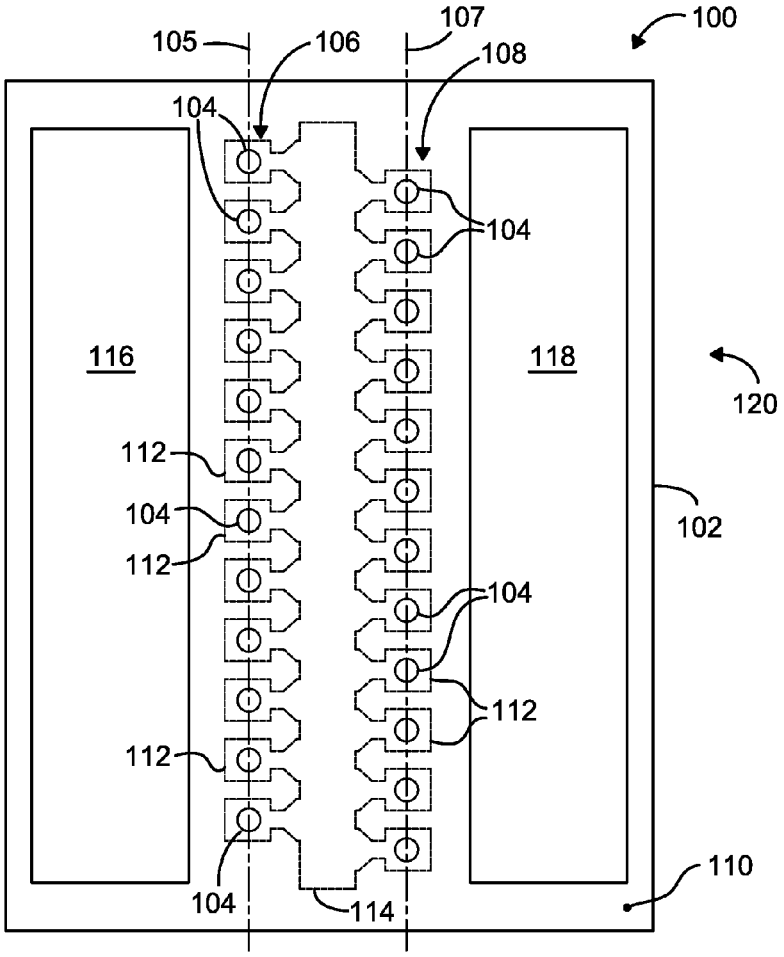
FIG. 1 is a plan view of a dispense head according to one example of the present teachings.

Reference is now directed to FIG. 1, which depicts a plan view of a dispense head 100. The dispense head 100 is illustrative and non-limiting with respect to the present teachings. Thus, other dispense heads devices and apparatus can be configured, formed or used in accordance with the present teachings. In one example, the dispense head 100 is used to dispense respective quantities of dissolved compounds in a pharmaceuticals testing context, another example, the dispense head 100 is applied to jet quantities of one or more different inks in an inkjet printing context. Other applications of the dispense head 100 can also be used.

The dispense head 100 includes a die or main portion 102. The die 102 is defined by a solid material. In one example, the 102 is formed from or includes silicon and has various features and aspects as described hereinafter formed by way of photolithography. Other materials or fabrication processes can also be used.

The dispense head 100 is characterized by a plurality of nozzles 104, arranged along lines 105 and 107 as a pair of respective rows 106 and 108, in particular, each nozzle 104 is an aperture extending from an outer surface 110 of the dispense head 100 inward to a corresponding firing chamber 112. In turn, each of the firing chambers 112 is fluidly coupled to a fluid slot 114 defined within the die 102. The fluid slot 114 defines a fluid conduit configured to provide fluid to each of firing chamber 112 during normal operations of the dispense head 100. Each of the nozzles 104 is therefore fluidly coupled to the fluid slot 114 by way of a respective firing chamber 112.

The dispense head 100 also ides a pair of channels or voids 116 and 118, respectively. Each channel 116 and 11 is defined by a respective void that extends from the outer surface 110 into the die 102. Each channel 116 and 118 is about rectangular in plan form and is defined by a depthwise dimension into the die 102. The channels 116 and 118 are parallel to each other and disposed in spaced adjacency to the rows 106 and 108 of nozzles 104. The channels 116 and 118 collectively define a surface pattern 120.

The surface pattern 120 functions to limit the size or volume of a puddle (or pool) of fluid that forms on the outer surface 110 during operation of the dispense head 100. In particular, the surface pattern 120 alters or disrupts the otherwise planar surface geometry of the outer surface 110 such that surface tension within the fluid limits puddle growth.

Another Illustrative Dispense Head

Figure 2:
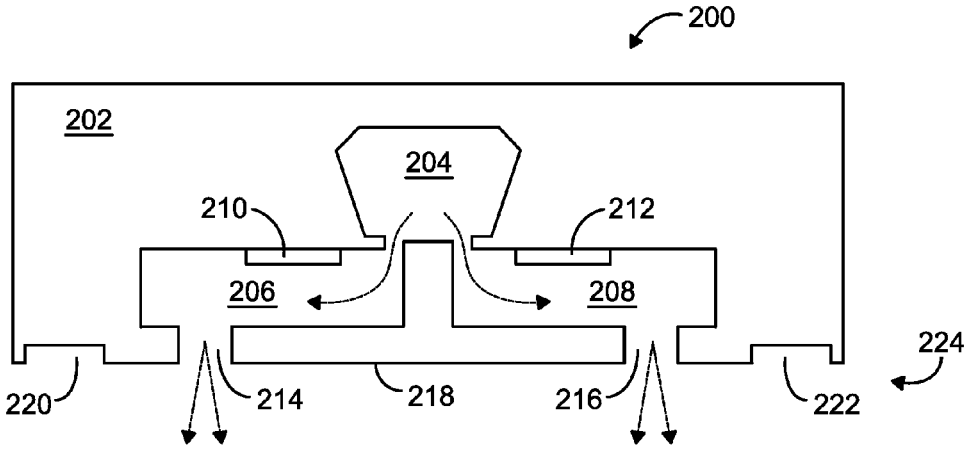
FIG. 2 is a schematic view of a dispense head according to another example.

Attention is now turned to FIG. 2, which depicts a schematic view of a dispense head 200. The dispense head 255 is illustrative and non-limiting with respect to the present teachings. Thus, the present teachings can be applied to other dispense heads, devices or apparatus. In one example, the dispense head 200 is essentially equivalent or analogous to the dispense head 100 described above. The dispense head 200 can be applied in various suitable contexts such as, without limitation, pharmaceuticals testing, inkjet printing, laboratory analysis, and so on.

The dispense head 200 includes a die 202 formed from a solid material such that a monolithic structure is defined.

Silicon or another suitable material can be used to form the die 202. The die 202 has been formed or processed using suitable techniques to define the respective features described below. In one example, the die 202 is formed by way of photolithography. Other processes can also be used.

The dispense head 200 is characterized by a fluid slot 204, defining a fluid conduit within the die 202. Fluid is provided to various features of the dispense head 200 by way of the fluid slot 204 during normal operation. The dispense head 200 also includes respective firing chambers 206 and 208. The firing chambers 206 and 208 are in fluid communication with the fluid slot 204 such that fluid can be provided to each during operation.

The dispense head 200 also includes a firing resistor 210 disposed within the firing chamber 206, and a firing resistor 212 disposed within the firing chamber 208. Each of the firing resistors 210 and 212 is configured to cause a rapid boiling of fluid within the respective firing chamber response electrical signaling. The dispense head 200 also includes a nozzle 214 that fluidly couples the firing chamber 206 to the exterior of the dispense head 200. Similarly, a nozzle 216 couples the firing chamber 208 to the exterior of the dispense head 200. The dispense head 200 is also characterized by an outer surface 218.

The dispense head 200 is further characterized by a channel 220 and a channel 222 formed the die 202. Each of the channels 220 and 222 is defined by a void having a rectangular cross-section and a linear length-wise aspect (normal to the drawing sheet). Each channel 220 and 222 is formed by a suitable process such as photolithography, laser ablation, and so on. Each channel 220 and 222 extends from the outer surface 218 inward to the die 202. Collectively, the respective channels 220 and 222 define a surface pattern 224.

Typical normal operation of the dispense head 200 is as follows: fluid is supplied to the dispense head 200 from an external source (not shown) filling the fluid slot 204. Fluid flows from the fluid slot 204 into the respective firing chambers 206 and 208. A controller external to the dispense head 200 sends electrical pulses or signals to the firing resistors 210 and 212, resulting in the controlled ejection of fluid from the nozzles 214 and 216, respectively.

Typically, fluid puddles or pools on the outer surface 218 of the dispense head 200 as printing operations progress. The fluid puddle spreads out laterally, eventually increasing in volume until the puddle edges come into contact with the channels 220 and 222. Surface tension of the fluid and the abrupt (i.e., square-edge) surface contour change at each channel 220 and 222 cause the fluid puddle to stop increasing in volume, generally holding a static size. The halted or limited size of the fluid puddle on the outer surface 216 reduces or eliminates various problems associated with incomplete dispensing or undesirable transfer of excess fluid to another entity.

In one example, the dispense head 200 is used to dispense varying amounts of fluid into receptacles of a wellplate. As used herein, a "wellplate" refers to a substrate formed to define an array (or matrix) of discrete receptacles. Wellplates are familiar to one having ordinary skill in the art of pharmaceuticals testing or similar technologies. Fluids dispensed in such a context can include, without limitation, DMSO (i.e., dimethyl sulfoxide), drugs or compounds dissolved in DMSO at various concentrations, and so on. The present teachings contemplate reducing or eliminating non-dispensed drops or dispensing failures when dispensing fluids into wellplates or other similar entities by virtue of surface patterns.

In another example, the dispense head 200 is used to dispense droplets of liquid ink on to a media. Such media can include, without limitation, sheet paper, roll-to-roll paper, roll-off paper, vinyl media, and so on. The present teachings contemplate reducing or eliminating streaks, spots or other undesirable artifacts that can occur on printed media by virtue of surface patterns.

Illustrative Fluid Puddle Limiting

Figure 3:
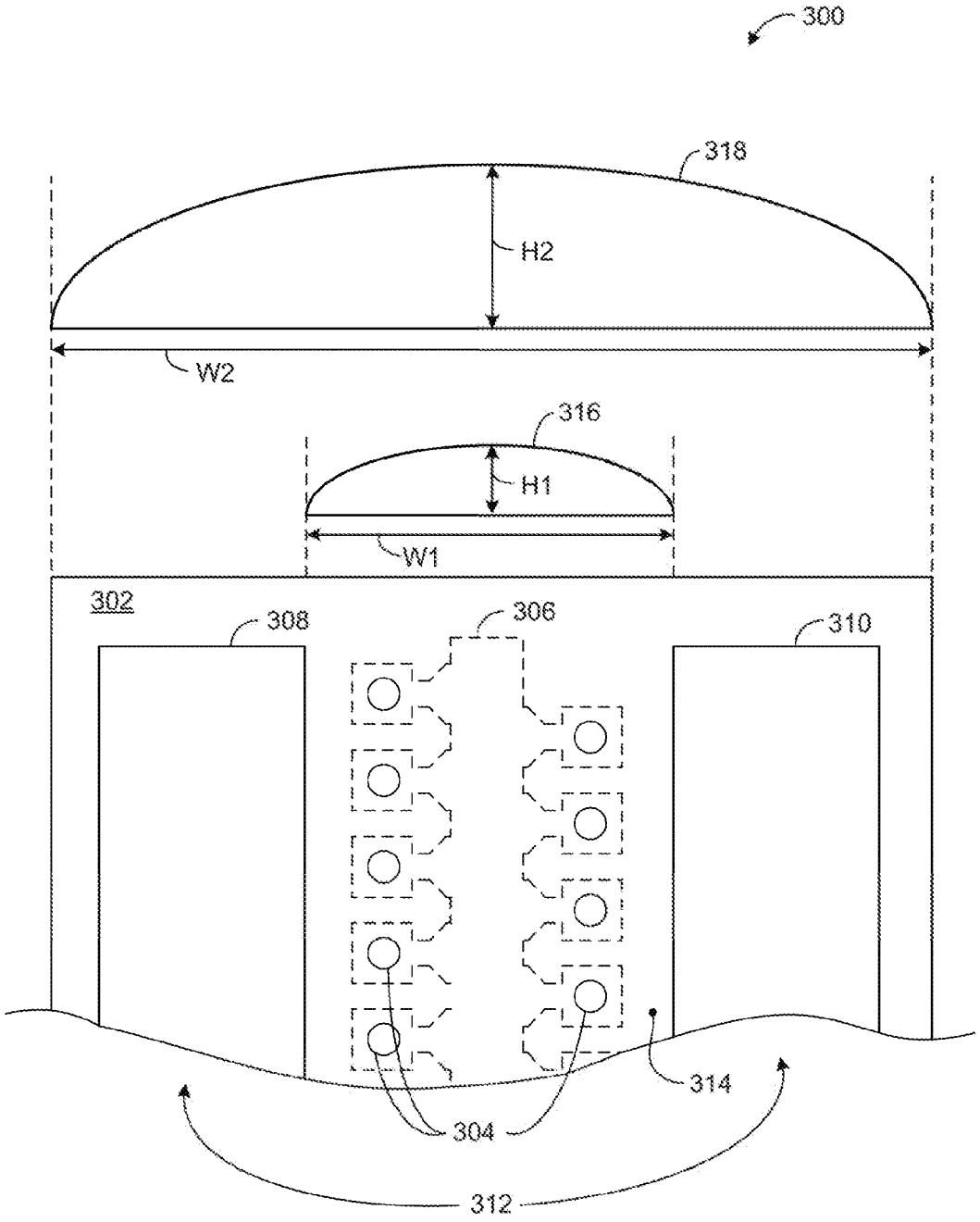
FIG. 3 depicts a dispense head operating scenario according to another example.

Reference is now made to FIG. 3, which depicts a dispense head operating scenario (scenario) 300. The scenario 300 is illustrative and non-limiting in nature. Other dispense heads or fluid dispensing heads having other respective characteristics or operating in accordance with other scenarios can also be used.

The scenario includes of a dispense 302 having a plurality of nozzles 304. The respective nozzles 304 are in fluid communication with a fluid slot (or conduit) 306 defined within the dispense head 302. Each nozzle 304 is configured to controllably eject fluid onto another entity in accordance with electrical signaling sent to a corresponding firing resistor.

The dispense lead 302 also includes or defines a rectangular channel 308 and a rectangular channel 310. Each of the respective channels 308 and 310 is spaced apart from the nozzles 304 and extends into the solid material of the dispense head 302. The channels 308 and 310 collectively define a surface pattern 312. In particular the surface pattern 312 defines respective step-changes in the otherwise planar surface 314 of the dispense head 302.

During typical normal operation of the dispense head 302, a fluid puddle eventually forms on the surface 314 and spreads outwardly away from the nozzles 304 until reaching the respective channels 308 and 310. Surface tension and the step-changes in surface contour function to limit the overall fluid puddle size and volume, as illustrated by the fluid puddle profile 316. The limited puddle contour 316 is characterized, by a maximum height H1 and a maximum width W1.

A fluid puddle 318 is also depicted. The fluid puddle 318 is illustrative of the sort of fluid pooling that can occur if the surface pattern 312 is omitted, and the surface 314 were essentially planar from edge-to-edge. The fluid puddle profile 318 is substantially larger in both maximum height H2 and maximum width W2 than H1 and W1, respectively, of the fluid puddle profile 316. Thus, the dispense head 302 is characterized by fluid puddle limiting during normal operation by virtue of the surface pattern 312.

First Illustrative Surface Pattern

Figure 4:
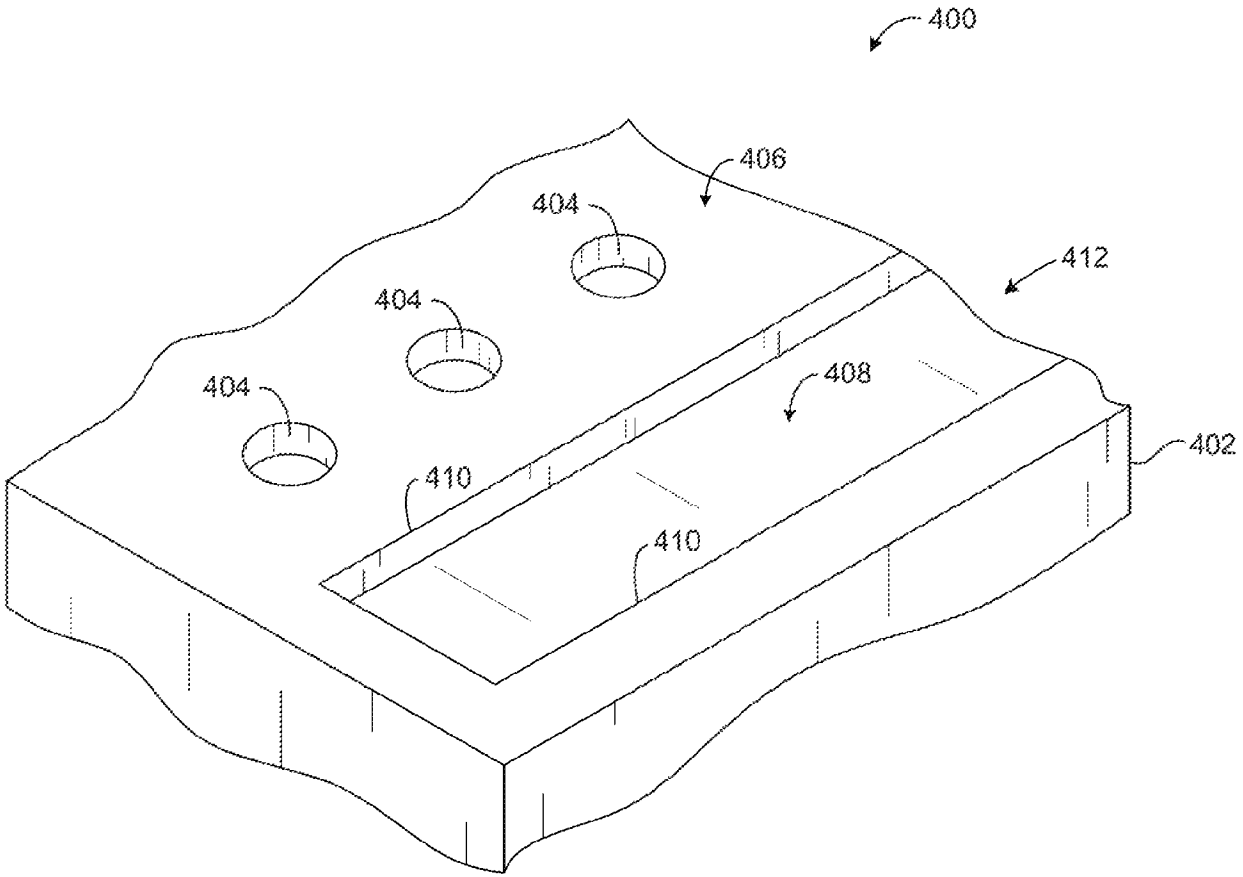
FIG. 4 is an isometric-like view of a portion of a dispense head according to one example.

Reference is now made to FIG. 4, which depicts an isometric-like view of a portion of a dispense head 400. The dispense head 400 and features thereof are illustrative and non-limiting with respect to the present teachings. Other dispense heads having other respective features are also contemplated by the present teachings. The dispense head 400 can be applied in various suitable contexts such as, without limitation, pharmaceuticals testing, inkjet printing, laboratory analysis, and so on.

The dispense head 400 includes a solid material defining a die 402. The die 402 is formed or processed by way of photolithography or another suitable process to define a plurality of nozzles 404. Each of the nozzles 404 is an aperture extending from an surface 404 into the dispense head 400. Each nozzle 404 is configured to direct or channel ejections of fluid onto another entity during normal typical operation of the dispense head 400.

The dispense head 400 is characterized by a channel 408. The channel 408 is linear in a length-wise aspect and extends from the outer surface 406 into the solid material of the die 402. The channel 408 is also character zed by a rectangular cross-sectional form such that square-edged or step-change features 410 are defined about the periphery. The channel 408 can be formed in the die 402 by way of photolithography, laser ablation, another suitable process.

The channel 408 is spaced apart from, yet relatively proximate to, the row of nozzles 404. The channel 408 functions to limit a size or volume of fluid puddling on the outer surface 40 during normal operation. The channel 408 defines, or is a portion of, a surface pattern 412 defined by the die 402.

Second Illustrative Surface Pattern

Figure 5:
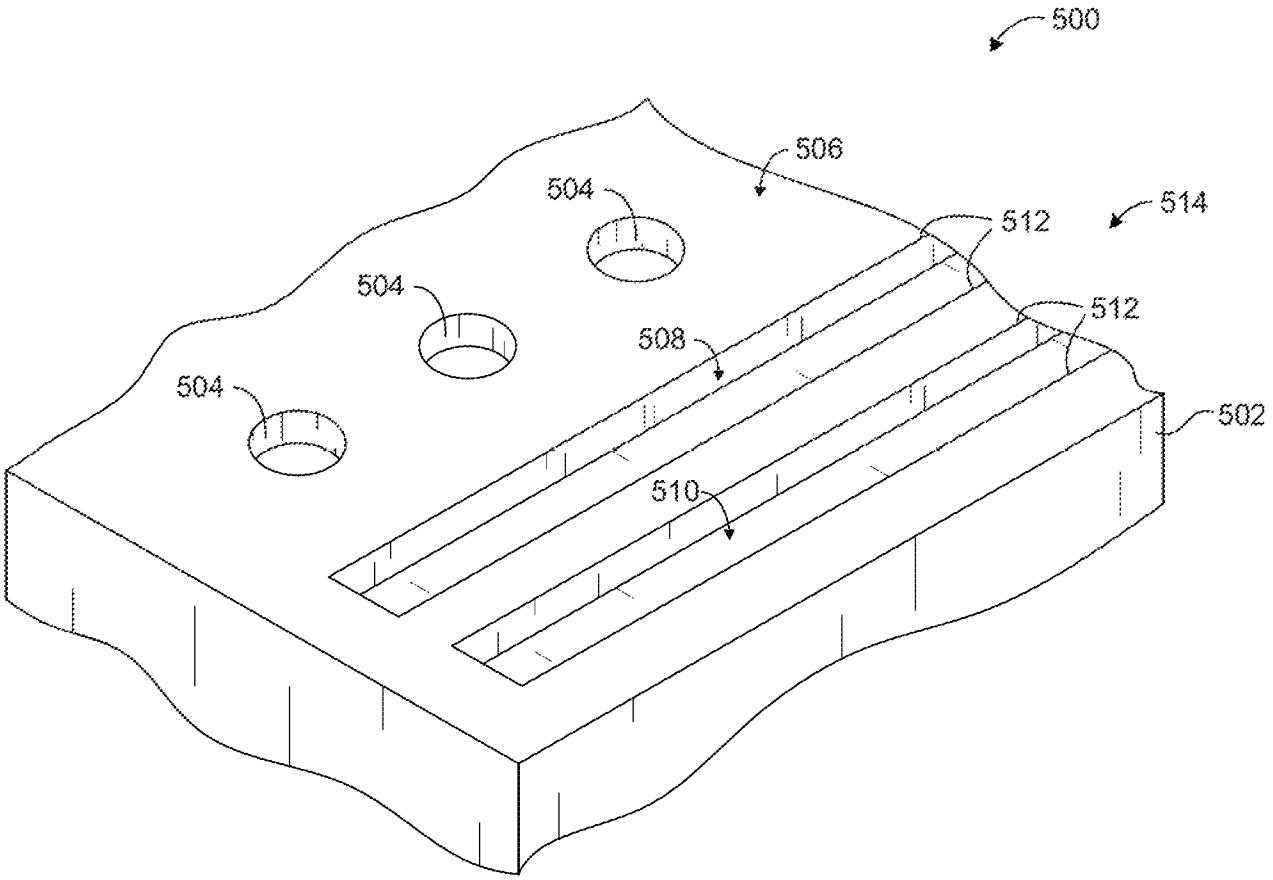
FIG. 5 is an isometric-like view of a portion of a dispense head according to another example.

Reference is now made to FIG. 5, which depicts an isometric-like view of a portion of a dispense head 500. The dispense head 500 and features thereof are illustrative and non-limiting with respect to the present teachings. Other dispense heads having other respective features are also contemplated by the present teachings. The dispense head 500 can be applied in various suitable contexts such as, without limitation, pharmaceuticals testing, inkjet printing, laboratory analysis, and so on.

The dispense head 500 includes a solid material defining a die 502. The die 502 is formed or processed by way of photolithography or another suitable process to define a plurality of nozzles 504. Each of the nozzles 504 is an aperture extending from an outer surface 506 into the dispense head 500. Each nozzle 504 is configured to direct ejections of fluid onto another entity during normal typical operation of the dispense head 500.

The dispense head 500 also includes or is characterized by a channel 508 and a channel 510. Each of the channels 508 and 510 is defined by a linear length-wise aspect and extends from the outer surface 506 into the solid material of the die 502. Each channel 508 and 510 is also characterized by a rectangular cross-sectional such that square-edge or step-change features 512 are defined about the respective peripheries. The channels 508 and 510 can be respectively formed by way of photolithography, ablation or another suitable process.

The channels 508 and 510 are parallel to each other and are disposed in spaced adjacency to the respective nozzles 504. The channels 508 and 510 function to limit a size or volume of fluid puddling on the outer surface 506 during normal operation of the dispense head 500. The channels 508 and 510 collectively define, or are portions of, a surface pattern 514.

Third Illustrative Surface Pattern

Figure 6:
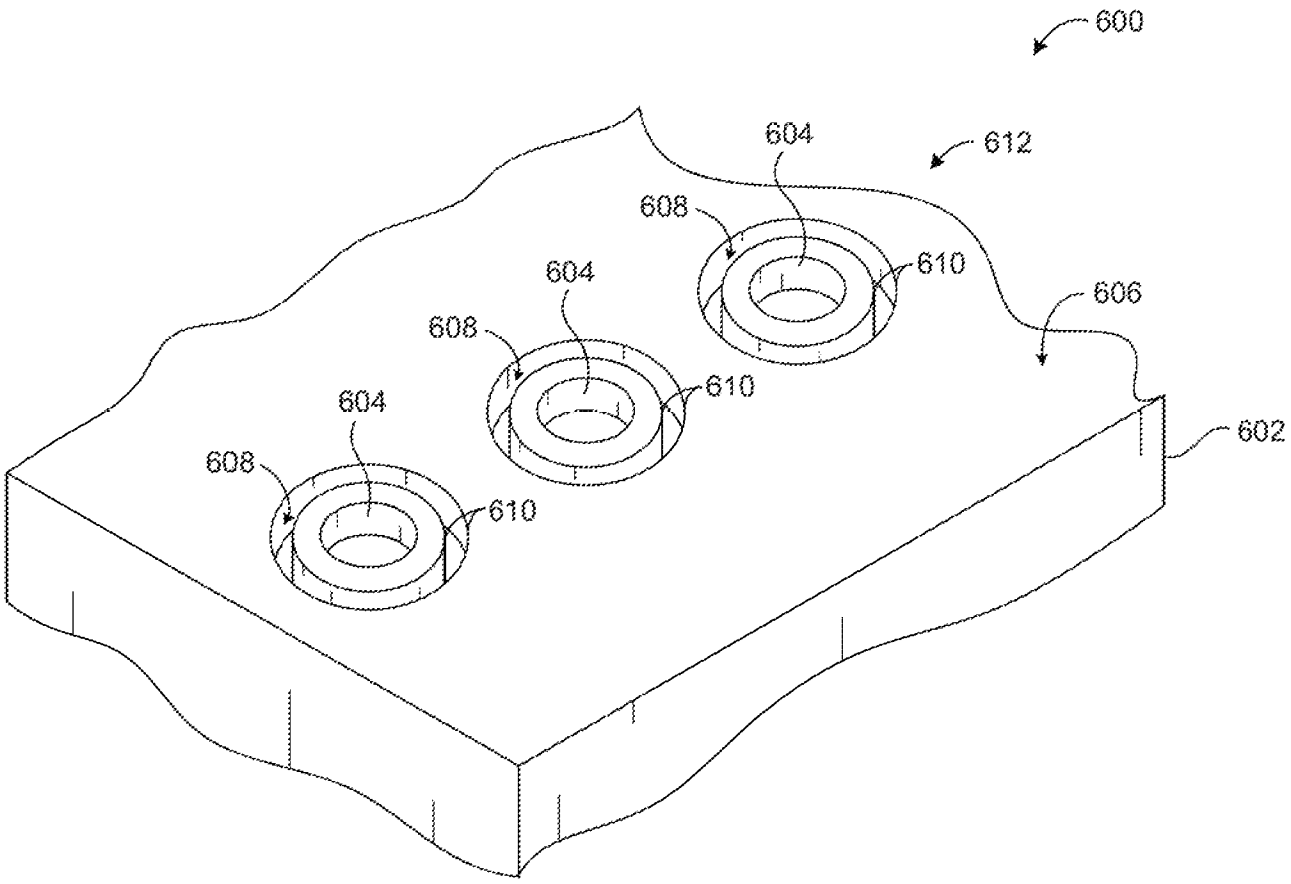
FIG. 6 is an isometric-like view of a portion of a dispense head according to another example.

Reference is now made to FIG. 6, which depicts an isometric-like view of portion of a dispense head 600. The dispense head 600 and features thereof are illustrative and non-limiting with respect to the present teachings. Other dispense heads having other respective features are also contemplated by the present teachings. The dispense head 600 can be applied in various suitable contexts such as, without limitation, pharmaceuticals testing; inkjet printing, laboratory analysis, and so on.

The dispense head 600 includes a solid material defining a die 602. The die 602 is formed or processed by way of photolithography or another suitable process to define a plurality of nozzles 604. Each nozzle 604 is an aperture extending from an outer surface 606 into the dispense head 600. Each nozzle 604 is configured to direct ejections of fluid onto another entity during normal typical operation of the dispense head 600.

The dispense head 600 is characterized by a plurality of annular channels 608. Each annular channel 608 is defined by a ring-like void disposed about a respective one of the nozzles 604. Also, each annular channel 608 extends from the outer surface 506 into the solid material of the die 502. Each of the annular channels 608 is formed such that square-edge or step-change features 610 are defined about the respective peripheries.

The annular channels 608 can be formed by way of photolithography, laser ablation, or another suitable process. Each annular channel 608 functions to limit a size or volume of fluid puddling on the outer surface 606 during normal operation of the dispense head 600. The annual channels 608 collectively define, or are portions of, a surface pattern 612.

Fourth Illustrative Surface Pattern

Figure 7:
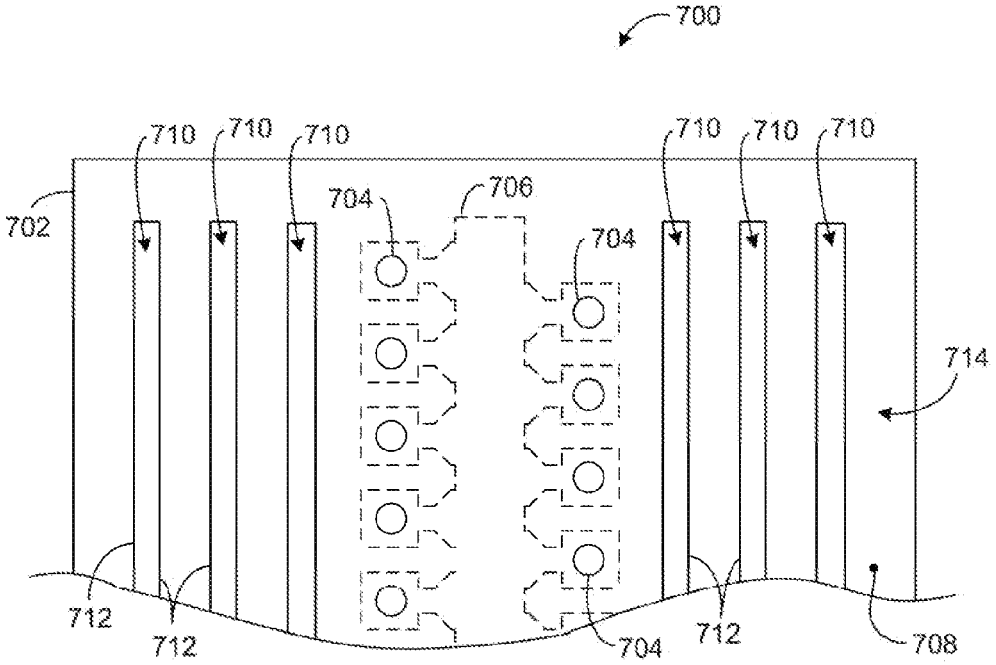
FIG. 7 is a plan view portion of a dispense head according to one example.

Reference is now made to FIG. 7, which depicts a plan view of a portion of a dispense head 700. The dispense head 700 and features thereof are illustrative and non-limiting with respect to the present teachings. Other dispense heads having other respective features are also contemplated by the present teachings. The dispense head 700 can be applied in various suitable contexts such as, without limitation, pharmaceuticals testing, inkjet printing, laboratory analysis, and so on.

The dispense head 700 includes a solid material defining a die 702. The die 702 is formed or processed by way of photolithography or another suitable process to define a plurality of nozzles 704. Each of the nozzles 704 is an aperture extending from an outer surface 708 into the die 702 and is in fluid communication with a fluid slot 706.

The dispense head 700 also includes or is characterized by a plurality of respective channels 710. Each channel 710 is defined by a linear length-wise aspect and each extends from the outer surface 708 into the solid material of the die 702. Each channel 710 is also characterized by a rectangular cross-sectional form such that square-edge or step-change features 712 are defined about the respective peripheries. The channels 710 can be respectively formed by way of photolithography, laser ablation, or another suitable process.

The channels 710 are parallel to each other and are disposed in spaced adjacency to the respective nozzles 704. The channels 710 function to limit a volume of fluid puddling on the outer surface 708 during normal operation of the dispense head 700. The channels 710 collectively define, or are portions of, a surface pattern 714.

Fifth Illustrative Surface Pattern

Figure 8:
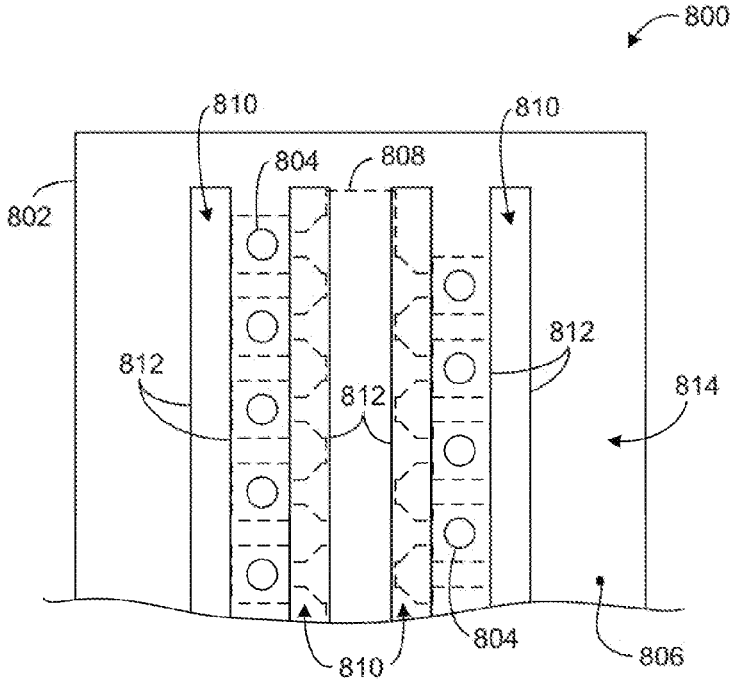
FIG. 8 is a plan view of portion of a dispense head according to another example.

Attention is now turned to FIG. 8, which depicts a plan view of a portion of a dispense head 800. The dispense head 800 and features thereof are illustrative and, non-limiting with respect to the present teachings. Other dispense heads having other respective features are also contemplated by the present teachings. The dispense head 800 can be applied in various suitable contexts has, without limitation, pharmaceuticals testing, inkjet printing, laboratory analysis, and so on.

The dispense head 800 includes a solid material defining a die 802. The die 802 is formed or processed by way of photolithography or another suitable process to define a plurality of nozzles 804. Each of the nozzles 804 is an aperture extending from an outer surface 806 into the die 802. The nozzles 804 are also in fluid communication with a fluid slot 808 defined within the die 802.

The dispense head 800 also includes or is characterized by a plurality of respective channels 810. Each channel 810 is defined by a linear length-wise aspect and each extends from the outer surface 806 into the solid material of the die 802. Each channel 610 is also characterized by a rectangular cross-sectional form such that square-edge or step-change features 812 are defined about the periphery thereof. The channels 810 can be respectively formed by way of photolithography, laser ablation, or another suitable process.

The channels 819 are parallel to each other and are disposed in very close adjacency to the respective nozzles 804. In particular, the channels 810 are disposed as pairs each member of a pair being on a respective side of a row of nozzles 804. Thus, a total of four channels 810 are disposed about two rows of nozzles 804. The channels 810 function to limit a size or volume of fluid puddling on the outer surface 806 during normal operation of the dispense head 800. The channels 810 collectively define, or are portions of, a surface pattern 814.

Illustrative Dispensing Apparatus

Figure 9:
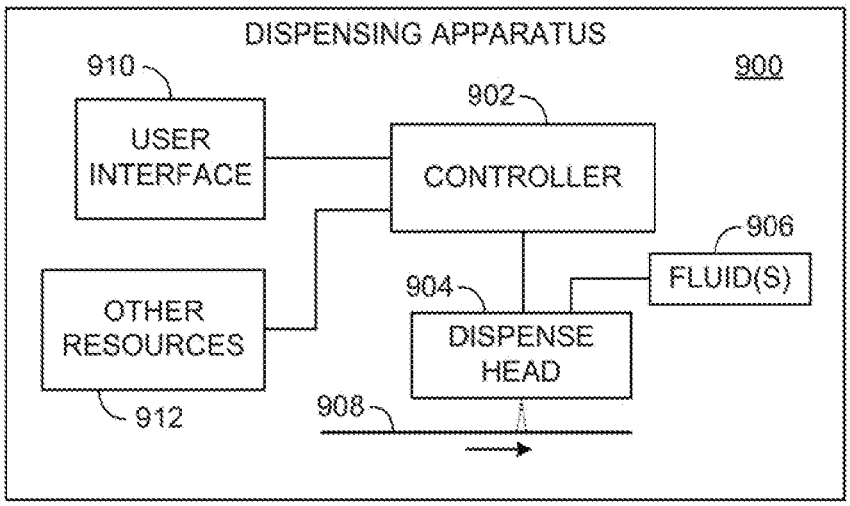
FIG. 9 is a block diagram of a fluid dispensing apparatus according to another example of the present teachings.

Reference is now made to FIG. 9, which depicts a block diagram of a dispensing apparatus (apparatus) 900. The apparatus 900 is illustrative and non-limiting with respect to the present teachings. Other apparatus, printers, fluid dispensers or systems can also be defined and used.

The apparatus 900 includes a controller 902. The controller 902 is configured to control various normal operations of the apparatus 900 including, in accordance with respective embodiments, dispensing patterns of fluid onto a wellplate, printing images or indicia onto a media, and so on. The controller 902 can be defined by any suitable electronic circuitry and can include, without limitation, a processor, a microcontroller, a state machine, digital or analog or hybrid circuitry, and so on.

The apparatus 900 also includes a dispense head 904 in accords with the present teachings. Thus, the dispense head 904 is analogous to any one of the dispense heads described above and includes a surface pattern. The dispense head 904 is coupled to a source of fluid 906 (e.g., liquid ink, DMSO, compound(s) dissolved in DMSO, or another) and is configured to dispense patterns of the fluid or fluids onto a receiving entity 908 in response to signals provided by the controller 902. In one example, the dispense head 904 is configured to dispense a liquid ink 906 onto paper media 908. In another example, the dispense head 904 is configured to dispense selected amounts of a dissolved compounds 906 into respective receptacles of a wellplate 908. Other examples are also contemplated.

The apparatus 900 also includes a user interface 910 coupled to the controller 902. The user interface 910 can be defined by or include pushbuttons, a keyboard, indicating lights, an audible annunciator, a display screen, and so on. Other suitable constituency can also be used. The apparatus 900 further includes other resources 912. Non-limiting examples of such other resources 91 include a power supply, network communications circuitry, wireless communications resources, document scanning resources, wellplate or media transporting or handling mechanisms, and so on. Other suitable resources can also be included.

An illustrative and non-limiting operation of the apparatus 900 is as follows: An electronic data file representing a wellplate dispense pattern is received at the controller 902. The controller 902 provides electronic control signaling to the dispense head 904 according to the wellplate dispense pattern. The dispense head 904 responds by controlled ejection of fluid into the wellplate 908 so as to perform the requested dispensing operation. The required fluid media is drawn from the fluid reservoir 906.

A fluid puddle progressively forms on the dispense head 904 during the course of the fluid dispensing operation. However, a surface pattern (e.g., 814) functions to limit fluid puddle growth such that non-dispensed drops or other dispensing failures are reduced or eliminated. The dispensing operation is eventually completed and the wellplate 908 can be taken from the apparatus 900 by a user.

Illustrative Method

Figure 10:
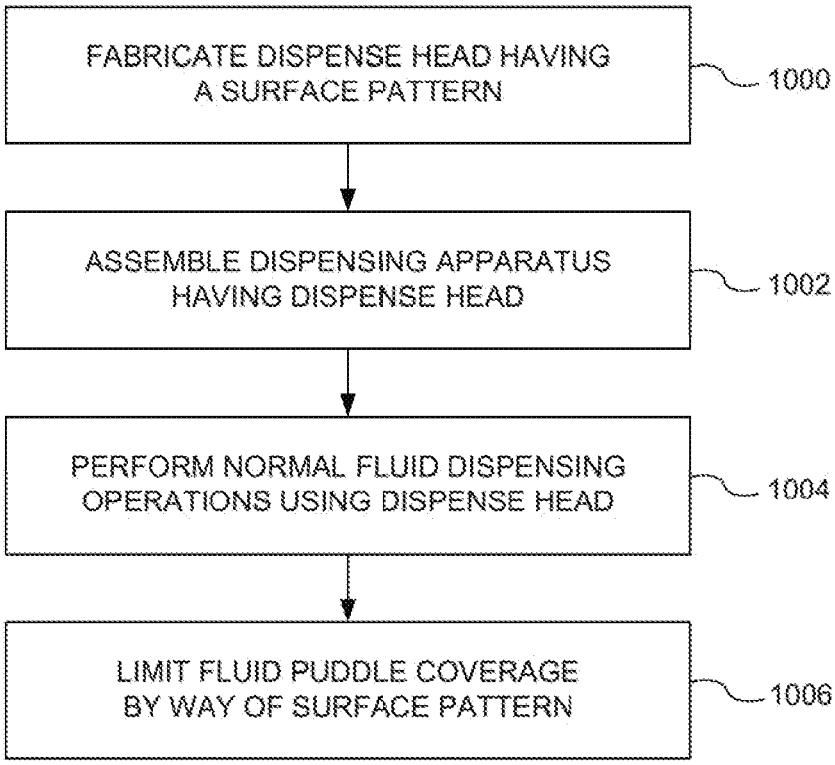
FIG. 10 is a flow diagram of a method according to pre teachings.

Reference is made now to FIG. 10, which depicts, a flow diagram of a method according to the present teachings. The method of FIG. 10 includes particular operations and order of execution. However, other methods including other operations, omitting one or more of the depicted operations, and/or proceeding in other orders of execution can also be used according to the present teachings. Thus, the method of FIG. 10 is illustrative and non-limiting in nature. Reference is also made to FIGS. 1 and 9 in the interest of understanding the method of FIG. 10.

At 1000, a dispense head is fabricated having a surface pattern. For purposes of a present example, a silicon substrate is formed or processed so as to define a die 102. The die 102 includes a plurality of nozzles 104, internal firing chambers 112 and an internal fluid slot 114. The die 102 further includes a surface pattern 120 defined by a channel 116 and a channel 118 respectively.

At 1002, a dispensing apparatus is assembled having the dispense head. For purposes of the present example, a dispensing apparatus 900 is assembled that includes the dispense head 904. The dispense head 904 is defined by or includes the die 102 fabricated at step 1000 above. The dispensing apparatus 900 further includes other constituency as desired.

At 1004, normal dispensing operations are performed using the dispense head. Under the present example, the dispensing apparatus 900 is operated normally so as to dispense fluid 906 onto a receiving entity 908 using the dispense head 904. Thus, a fluid 906 (e.g., liquid ink, dissolved compounds, and so on) is controllably ejected on to the entity 908 (e.g., paper media, a wellplate, and so on) by way of the nozzles 104 of the die 102.

At 1006, fluid puddle volume is limited by way of the surface pattern. For purposes of the present example, a fluid puddle that forms on the dispense head 904 is limited in size (volume and/or coverage area) by surface tension-interaction with the surface pattern 120. Dispensing failures or other undesirable effects are reduced or eliminated by way of the surface pattern 120.

In general, and without limitation, the present teachings contemplate dispense heads having respective surface patterns and their use. A solid material such as silicon or another suitable material is processed by photolithography, laser ablation or another process to define a dispense head (or die) characterized by nozzles and other features. The dispense head is also characterized by an outer surface adjacent to and generally surrounding the plurality of fluid-eject/on nozzles.

A surface pattern characterized by one or mere voids is defined in the solid material of the dispense head. The surface pattern can include linear channels (or trenches), annular channels (or rings) or other geometries that extend from the outer surface into the solid material of the dispense head. In particular, each feature of the surface pattern is defined by a rectangular (or nearly so) cross-sectional shape such that square-edged or step-change features are defined about the periphery.

The resulting deviations in the otherwise planar outer surface of the dispense head attributable to the surface pattern function to limit a spread or volume of fluid puddling that forms during normal operations. Limited fluid puddling reduces or eliminates dispensing errors, undesirable printing artifacts; or the transfer of spurious quantities of fluid onto a receiving entity.

In general, the foregoing description is intended to be illustrative and not restrictive. Many embodiments and applications other than the examples provided would be apparent to those of ordinary skill in the art upon reading the above description. The scope of the invention should be determined, not with reference to the above description, but should instead be determined with reference to the appended claims; along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. A dispense head, comprising:

a row of fluid-jetting nozzles each having a discharge end at an exposed outer face of a material; and a surface pattern on the exposed outer face of the material spaced apart from the discharge end of each nozzle such that there is un-patterned material everywhere between the surface pattern and each nozzle, the surface pattern including an abrupt edge extending continuously along a full length of the row of nozzles to limit a volume of a fluid puddle forming on the exposed outer face of the material during operation.

2. The dispense head according to claim 1, where the abrupt edge is defined by at least one linear void having a depth-wise dimension extending from the exposed outer face into the material.

3. The dispense head according to claim 2, where:

the row of nozzles includes a first row of nozzles and a second row of nozzles parallel to the first row of nozzles; and the abrupt edge extends continuously along the full length of each row of nozzles.

4. The dispense head according to claim 3, where the abrupt edge is defined by first and second linear voids each having a depth-wise dimension extending from the exposed outer face into the material and where the first linear void extends continuously along the full length the first row of nozzles and the second linear void extends continuously along the full length of the second row of nozzles.

5. The dispense head according to claim 4, the material being a monolithic solid formed to define the fluid-jetting nozzles and the surface pattern.

6. The dispense head according to claim 5, the material further defining a firing chamber and a fluid supply conduit in fluid communication with the fluid jetting nozzles.

7. A fluid dispensing apparatus, comprising:

a dispense head configured to eject fluid through a row of nozzles, each nozzle extending from a discharge end at an exposed outer face of the dispense head inward toward a corresponding firing chamber from which fluid may be dispensed through the nozzle, and where the exposed outer face includes an uninterrupted planar part next to and completely surrounding the discharge end of each nozzle and a channel adjoining the planar part and extending continuously along the row of nozzles to limit fluid puddle formations on the exposed outer face of the dispense head adjacent to the nozzles during operation; and a controller configured to control operation of the dispense head so as to dispense patterns of fluid to a receiving entity.

8. The fluid dispensing apparatus according to claim 7, the channel including one or more linear channels extending inward from the exposed outer face of the dispense head.

9. The fluid dispensing apparatus according to claim 8, the channel including first and second linear channels extending inward from the exposed outer face of the dispense head and extending parallel to one another continuously along opposite sides of the row of the nozzles.

10. The fluid dispensing apparatus according to claim 7, the controller configured such that the dispense head dispenses patterns of dissolved compounds into receptacles of a wellplate, or patterns of liquid ink onto a media.

11. A dispense head, comprising:

a first group of nozzles through which fluid may be dispensed from the head, the nozzles in the first group arranged along a first line;

a second group of nozzles through which fluid may be dispensed from the head, the nozzles in the second group arranged along a second line parallel to the first line;

a surface surrounding each of the nozzles;

a first channel in the surface, the first channel spaced apart from the nozzles such that no part of the first channel intersects any of the nozzles, and the first channel extending along one side of the first group of nozzles opposite the second group of nozzles; and a second channel in the surface, the second channel spaced apart from the nozzles such that no part of the second channel intersects any of the nozzles, and the second channel extending along one side of the second group of nozzles opposite the first group of nozzles.

12. The dispense head according to claim 11, comprising a third channel in the surface, the third channel spaced apart from the nozzles such that no part of the third channel intersects any of the nozzles, and the third channel extending between the first group of nozzles and the second group of nozzles parallel to the first channel and the second channel.

13. The dispense head according to claim 11, where there is no channel in the surface between the first group of nozzles and the second group of nozzles.

14. The dispense head according to claim 11, where:

the first channel comprises multiple first channels extending parallel to one another along one side of the first group of nozzles opposite the second group of nozzles; and the second channel comprises multiple second channels extending parallel to one another along one side of the second group of nozzles opposite the first group of nozzles.

15. The dispense head according to claim 12, where the third channel comprises multiple third channels extending parallel to one another between the first group of nozzles and the second group of nozzles.

16. The dispense head according to claim 11, where:

the nozzles in the first group are arranged in a row along the first line; and the nozzles in the second group are arranged in a row along the second line.

* * * * *